United States Patent [19]

Mazzarolo

[11] Patent Number: 4,693,021

[45] Date of Patent: Sep. 15, 1987

[54] VENTILATED ITEM OF SPORT FOOTWEAR, PARTICULARLY FOR MOTORCYCLISTS

[75] Inventor: Sante Mazzarolo, Coste di Maser, Italy

[73] Assignee: Alpine Stars S.p.A., Coste di Maser, Italy

[21] Appl. No.: 781,817

[22] Filed: Sep. 30, 1985

[30] Foreign Application Priority Data

Oct. 10, 1984 [IT] Italy ..... 59366/84[U]

[51] Int. Cl.[4] ..... A43B 5/14; A43B 7/08; A43B 7/06

[52] U.S. Cl. ..... 36/131; 36/3 A:3 R

[58] Field of Search ..... 36/3 R, 3 A, 117, DIG. 1, 36/29, 131; 2/410, 425, 171.3, DIG. 1

[56] References Cited

U.S. PATENT DOCUMENTS

| | | | |
|---|---|---|---|
| 1,168,166 | 1/1916 | Cook | 36/3 A |
| 1,890,433 | 12/1932 | Cohen | 36/3 B |
| 1,949,159 | 2/1934 | Glidden et al. | 36/3 A |
| 2,356,490 | 8/1944 | Crotty | 36/3 A |
| 2,591,454 | 4/1952 | Manning | 36/3 A |
| 2,614,339 | 10/1952 | Herceg | 36/3 A |
| 3,925,912 | 12/1975 | Martineau | 36/3 R |
| 4,267,651 | 5/1981 | Albano | 36/131 |
| 4,458,429 | 7/1984 | Schmid | 36/3 A |
| 4,468,869 | 9/1984 | Fukuoka | 36/3 R |
| 4,555,816 | 12/1985 | Broersma | 2/171.3 |
| 4,563,825 | 1/1986 | Tesser | 36/131 |
| 4,587,749 | 5/1986 | Berlese | 36/131 |

FOREIGN PATENT DOCUMENTS

| | | | |
|---|---|---|---|
| 0177892 | 4/1986 | European Pat. Off. | 36/131 |
| 1609416 | 6/1950 | Fed. Rep. of Germany . | |
| 1948632 | 10/1966 | Fed. Rep. of Germany . | |
| 7604530 | 2/1976 | Fed. Rep. of Germany . | |
| 769382 | 8/1934 | France | 36/3 A |
| 2413053 | 8/1979 | France | 36/131 |
| 2522587 | 9/1983 | France | 2/DIG. 1 |
| 13708 | of 1893 | United Kingdom | 36/3 A |
| 2057248 | 4/1981 | United Kingdom | 36/3 A |

*Primary Examiner*—Henry S. Jaudon
*Assistant Examiner*—Steven N. Meyers
*Attorney, Agent, or Firm*—Guido Modiano; Albert Josif

[57] ABSTRACT

The footwear item comprises an upper having a structure associated internally therewith. The structure is composed of a perforated liner, and a mesh. A grid is inserted therebetween and has enlarged knots provided with spacer elements. The liner is placed in contact with a wearer's foot while the mesh is adapted to contact the inner surface of the upper. The upper includes a plurality of apertures for allowing air therethrough.

6 Claims, 2 Drawing Figures

VENTILATED ITEM OF SPORT FOOTWEAR, PARTICULARLY FOR MOTORCYCLISTS

BACKGROUND OF THE INVENTION

This invention relates to a ventilated item of sport footwear, in particular a boot for motorcyclists, useful in the fields of trials riding or motorcross. Much felt by athletes is today the problem of excessive perspiration occurring on the inside of the footwear during its use.

In order to solve this problem, some known types of footwear have been developed which are apertured to allow to flow into and out of a footwear item.

However, such known types are not devoid of drawbacks, such as inadequate ventilation, since the holes have of necessity limited dimensions, and the limitativeness itself of such ventilation, this only affecting the areas adjacent the holes.

Such drawbacks are all the more apparent where a boot for motorcyclists is considered, due to its particular utilization and use.

SUMMARY OF THE INVENTION

It is a primary aim of this invention to remove the above drawbacks affecting known types, by providing an item of sport footwear the interior whereof can be ventilated.

A further important object is to provide an item of footwear the interior whereof is fully and effectively ventilated.

Another object is to provide an item of footwear which can enhance, in use, the internal exchange of air.

These and other objects are achieved by a ventilated item of sport footwear comprising an upper which is characterized in that, associated internally therewith, is a structure formed of a number of air-pervious elements, said elements including at least a first perforated element and a mesh, a grid means being inserted therebetween which has enlarged knots and spacer elements and is pervious to air, said perforated element and mesh being disposed the one in contact with the foot and the other in contact with the inside surface of the upper, the latter having a plurality of aperatures for allowing air therethrough.

BRIEF DESCRIPTION OF THE DRAWINGS

Further features and advantages will be apparent from the following detailed description of a particular embodiment of the invention, taken in conjunction with the accompanying illustrative and not limitative drawing sheet, where.

DESCRIPTION OF THE PREFERRED EMBODIMENTS

Figure 1:
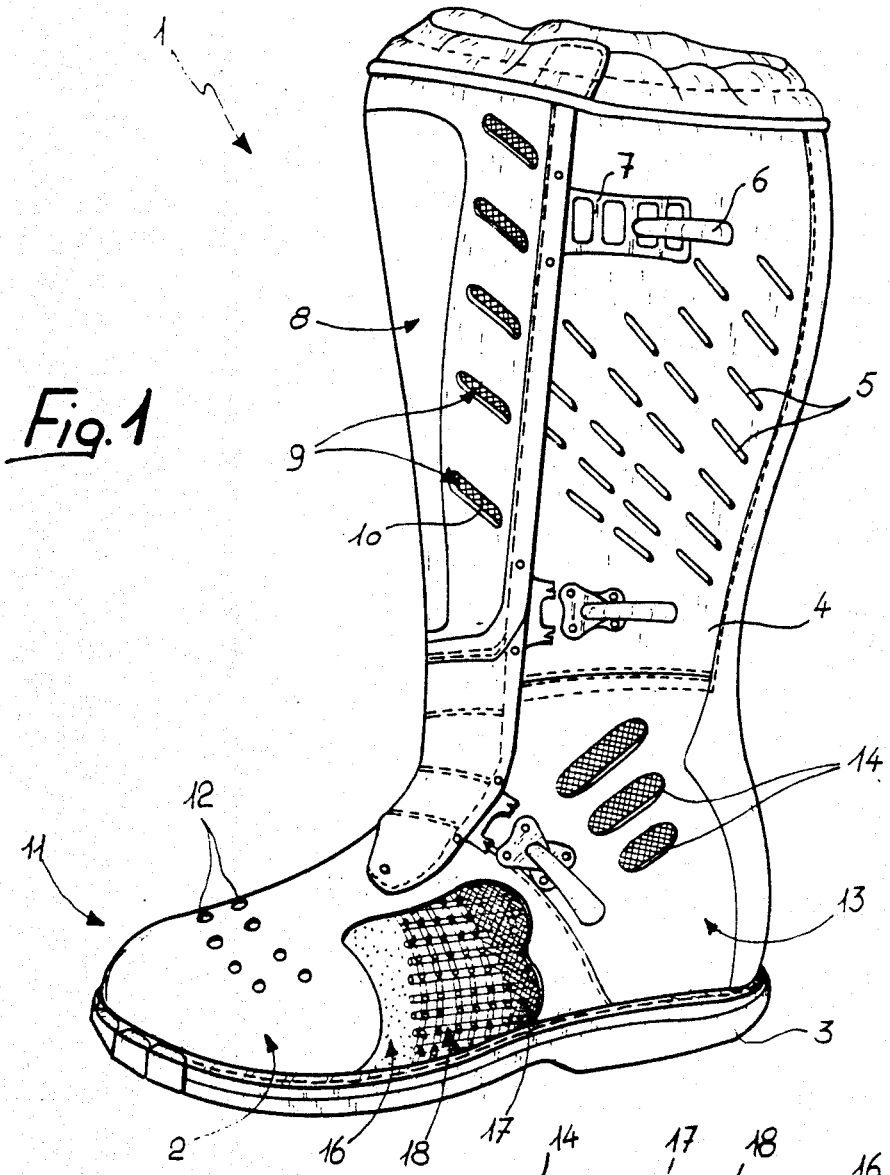
FIG. 1 is a three-quarter side view of a boot for motorcyclists, showing partly in section the inner construction of the upper.
Figure 2:
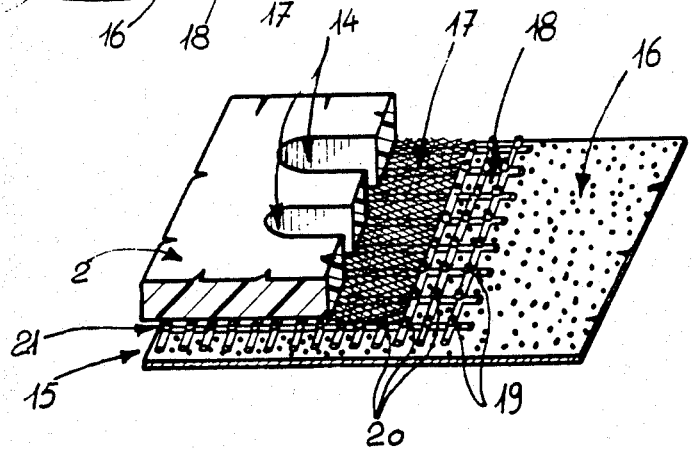
FIG. 2 shows the particular construction used.

With reference to the cited drawing figures, the numeral 1 designates a boot for motorcyclists particularly useful in the field of trails riding or motorcross.

In the particular form selected, the boot 1 is composed of an upper 2 of waterproof material associated downwardly with a rubber sole 3 and upwardly with a quarter 4 which may be formed of plastic, having a plurality of apertures 5 advantageously laid parallel to one another obliquely to the axis of the quarter.

Also associated with the latter are metal levers 6 interacting with matingly shaped straps 7 of plastics made rigid with a rigid front shin guard 8, associated on one side with the quarter 4 and downwardly with the upper 2.

The surface of the shin guard 8 is also provided with a plurality of secondary apertures 9, similar to the apertures 5 but preferably of a slightly larger size, on the inside surface of the shin guard 8 there being attached a coarse mesh 10.

The upper 2 has in the front area 11 of the tip a plurality of apertures or holes 12 expediently of circular shape and arranged in two rows.

In the side area 13 of the upper 2, substantially corresponding to the rest point of the malleolus, there are present a plurality of apertures 14 laid parallel to one another and of essentially elliptical shape.

With the interior of the upper 2 there is associated an air-pervious structure 15 completely enclosing the top portion of the user's foot; that portion bears on a first element, forming the structure, comprising a perforated hide liner 16.

A second element concurs in forming the structure 15 which comprises a mesh 17 made of nylon and having a fine mesh size, to be seen through the apertures 12 and 14.

A third element composes the structure 15: it comprises a grid means 18 with enlarged knots interposed to the liner 16 and mesh 17, that means having at the knots 19 spacer elements including small pegs 20 which rest with their free top ends 21 on the mesh 17.

In assembling, the inner surface of the upper 2, the mesh 17 rests on the small pegs 21 of the grid means 18, on which there finally rests the liner 16, the latter being associated with the upper itself.

The structure 15 inserted into the boot 1 operates as follows:

After inserting the foot into the upper interior, the small pegs 20 of the means 18 form a chamber interposed between the foot itself and the upper, allowing air to circulate both inwards, through the perforated liner 16, means 18, mesh 17 and apertures provided in the upper, and outwards, its path being exactly the reverse.

Every movement of the foot, moreover, will tend to compress the small pegs 20 of the spacer means 18 against the mesh 17 and, hence, the upper 2; this will create a forced movement of the air inside the structure 15, thus enabling further ventilation of the interior of the upper 2.

The number, position and size of the apertures 12 and 14 allow optimization of that air flow.

It has been ascertained that the ventilated item of sport footwear, particularly for motorcyclists, achieves all of the objects set forth, affording a considerable ventilation of the upper, given the presence of the grid means 18 and of the small pegs associated therewith which keep the perforated hide liner 16 separate from the mesh 17 and, hence, the upper 2.

Thus, the foot is never in direct contact with the inner surface of the upper itself, its movement contributing to an increased circulation of the air flow inwards and/or outwards of the upper.

The structure 15 enclosing the whole inner surface of the upper, the foot area affected by the air flow is greatly increased, thus improving the foot transpiration.

In the particular embodiment described the structure 15 has been limited to just the upper, quarter, and shin guard presenting a set of apertures for the air to enter and exit.

Of course, the invention herein is susceptible to many modifications and changes: thus, for example, the structure 15 could span, in the instance of the boot, both the quarter and shin guard.

Furthermore, all the details may be replaced with technically equivalent elements.

The materials used, as well as the size of the mesh, that of the liner holes, or that of the apertures and their number, may be any ones contingent on requirements.

What is claimed is:

1. A ventilated item of sport footwear comprising:

an upper, said upper having an inner face in contact with an air-pervious structure, said structure including:

a mesh in contact with the inner face of the upper; a grid in contact with a side of the mesh opposite the inner face of the upper; and a perforated element in contact with a side of the grid opposite the mesh;

wherein said grid comprises a plurality of knots having spacer elements thereon, and wherein said upper has a plurality of apertures for allowing air therethrough and through said air-pervious structure.

2. A ventilated item according to claim 1 wherein:

said grid comprises a coarse mesh structure, and said spacer elements comprise a plurality of identical small pegs projection from said knots, toward said mesh, and having free ends which rest on said mesh.

3. A ventilated item according to claim 1 wherein:

said perforated element is comprised of a liner spanning the whole inner face of said upper.

4. A ventilated item according to claim 1 wherein:

said mesh is comprised of a fine size mesh formed from plastics.

5. A ventilated item according to claim 1 wherein:

said upper presents a plurality of apertures for putting said mesh in communication with the outside of said footwear.

6. A ventilated item according to claim 1 wherein:

said plurality of apertures are formed in a toe portion of said upper and in a side area of said upper at the ankle.

* * * * *